US011682348B2

(12) United States Patent
Yan et al.

(10) Patent No.: US 11,682,348 B2
(45) Date of Patent: Jun. 20, 2023

(54) DISPLAY PANEL, DISPLAY DEVICE AND DISPLAY METHOD

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Rongjian Yan, Beijing (CN); Jeonghaeng Heo, Beijing (CN); Zhaowei Yu, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/483,260

(22) Filed: Sep. 23, 2021

(65) Prior Publication Data

US 2022/0301503 A1 Sep. 22, 2022

(30) Foreign Application Priority Data

Mar. 19, 2021 (CN) ..... 202110293652.9

(51) Int. Cl.
*G09G 3/3225* (2016.01)
*G09G 3/3266* (2016.01)
*G09G 3/3275* (2016.01)

(52) U.S. Cl.
CPC ..... *G09G 3/3225* (2013.01); *G09G 3/3266* (2013.01); *G09G 3/3275* (2013.01);
(Continued)

(58) Field of Classification Search
CPC .. G09G 3/3225; G09G 3/3266; G09G 3/3275; G09G 2300/0819;
(Continued)

(56) References Cited

U.S. PATENT DOCUMENTS

2017/0251137 A1* 8/2017 Evans, V ..... G02F 1/133526
2018/0061315 A1* 3/2018 Kim ..... G09G 3/3275
2021/0193785 A1* 6/2021 Kim ..... H01L 27/3234

FOREIGN PATENT DOCUMENTS

CN 108922900 A 11/2018
CN 111462695 A 7/2020
CN 112017549 A 12/2020

OTHER PUBLICATIONS

Office Action received for Chinese Patent Application No. 202110293652.9, dated Nov. 19, 2021, 16 pages (7 pages of English Translation and 9 pages of Office Action).

* cited by examiner

*Primary Examiner* — David Tung
(74) *Attorney, Agent, or Firm* — Womble Bond Dickinson (US) LLP

(57) ABSTRACT

The present disclosure provides a display panel and a display method for use in the display panel. The display panel includes: a display region, the display region comprising a first display region and a second display region, the first display region comprising a transparent sub-display region, the transparent sub-display region having a light transmittance higher than that of the second display region; and a first light emission controller and a second light emission controller, the first light emission controller being configured to provide a light emission control signal to a plurality of pixel rows of the first display region, the second
(Continued)

light emission controller being configured to provide a light emission control signal to a plurality of pixel rows of the second display region.

17 Claims, 7 Drawing Sheets

(52) U.S. Cl.
CPC ..... *G09G 2300/0819* (2013.01); *G09G 2300/0842* (2013.01); *G09G 2310/08* (2013.01); *G09G 2320/0626* (2013.01)

(58) Field of Classification Search
CPC ..... G09G 2300/0842; G09G 2310/08; G09G 2320/0626; G09G 2360/14; H01L 27/3227; H01L 27/3234
See application file for complete search history.

DISPLAY PANEL, DISPLAY DEVICE AND DISPLAY METHOD

RELATED APPLICATION

The present application claims the benefit of Chinese Patent Application No. 202110293652.9 filed on Mar. 19, 2021, the entire disclosure of which is incorporated herein by reference.

TECHNICAL FIELD

The present disclosure relates to the field of display technologies, particularly to a display panel, a display device and a display method.

BACKGROUND

In the related art, display technologies such as active matrix organic light emitting diodes (AMOLED), quantum dot light emitting diodes (QLED), and the like have developed rapidly. Especially for the AMOLED technology, it is advantaged by wide color gamut, fast response speed, wide viewing angle, foldability, and so on. AMOLED will develop towards the directions such as full screen and function integration in the future. However, due to the influence of the screen transmittance, under-screen cameras, under-screen infrared sensors, etc. are still at a technological development stage and there is no condition for mass production.

SUMMARY

Embodiments of the present disclosure provide a display panel, a display device and a display method.

According to an embodiment of the present disclosure, there is provided a display panel. The display panel includes: a display region, the display region including a first display region and a second display region, the first display region including a transparent sub-display region, the transparent sub-display region having a light transmittance higher than a light transmittance of the second display region; and a first light emission controller and a second light emission controller, the first light emission controller being configured to provide a light emission control signal to a plurality of pixel rows of the first display region, the second light emission controller being configured to provide a light emission control signal to a plurality of pixel rows of the second display region.

In some embodiments, the display panel further includes: a timing controller; wherein the timing controller is configured to provide a light emission driving signal to the first light emission controller and the second light emission controller.

In some embodiments, the display panel further includes: a gate driver; wherein the gate driver is configured to provide a gate driving signal to a pixel row of the display region, and the timing controller is configured to provide a scan driving signal to the gate driver.

In some embodiments, the display panel further includes: a data driver; wherein the data driver is configured to provide a data signal to a pixel column of the display region, and the timing controller is configured to provide a data driving signal to the data driver.

In some embodiments, a pixel anode of the transparent sub-display region is made of a transparent material; the transparent material includes at least one of indium tin oxide, indium zinc oxide, silver-doped indium tin oxide, and silver-doped indium zinc oxide.

In some embodiments, the pixel anode of the transparent sub-display region is a pixel anode of a monolayer structure.

In some embodiments, the pixel anode of the transparent sub-display region is a pixel anode of a multilayer structure.

In some embodiments, the display panel further includes: a base substrate, a backplane module, and a light emitting layer that are stacked in sequence; wherein the pixel anode is formed in the light emitting layer, and the first light emission controller and the second light emission controller are configured to provide a light emission driving signal to the backplane module so that the backplane module drives the light emitting layer to emit light.

In some embodiments, the backplane module includes a buffer layer, an active layer, a first gate insulating layer, a first gate layer, a second gate insulating layer, a second gate layer, an interlayer dielectric layer, a source/drain electrode layer, a planarization layer, an anode, a pixel defining layer and a support layer that are stacked in sequence.

In some embodiments, the display panel further includes: an optical module; wherein the optical module includes at least one of a polarizer, an optical glue and a cover glass.

In some embodiments, the transparent sub-display region coincides with the first display region.

In some embodiments, the display panel further includes: a non-display region adjacent to the display region; wherein the first light emission controller and the second light emission controller are located within the non-display region.

According to an embodiment of the present disclosure, there is provided a display device. The display device includes the display panel described in any of the foregoing embodiments and a photosensitive element, the photosensitive element being arranged on a back side of the display panel and configured to receive light passing through the transparent sub-display region.

In some embodiments, the photosensitive element includes at least one of a photographing camera, an infrared camera, an infrared rangefinder, and an optical fingerprint sensor.

In some embodiments, the display device further includes: a timing controller; wherein the timing controller is configured to provide a light emission driving signal to the first light emission controller and the second light emission controller.

In some embodiments, the display device further includes: a gate driver; wherein the gate driver is configured to provide a gate driving signal to a pixel row of the display region, and the timing controller is configured to provide a scan driving signal to the gate driver.

In some embodiments, the display device further includes: a data driver; wherein the data driver is configured to provide a data signal to a pixel column of the display region, and the timing controller is configured to provide a data driving signal to the data driver.

In some embodiments, a pixel anode of the transparent sub-display region is made of a transparent material; the transparent material includes at least one of indium tin oxide, indium zinc oxide, silver-doped indium tin oxide, and silver-doped indium zinc oxide.

In some embodiments, the display device further includes: a base substrate, a backplane module, and a light emitting layer that are stacked in sequence; wherein the pixel anode is formed in the light emitting layer, and the first light emission controller and the second light emission controller are configured to provide a light emission driving signal to the backplane module so that the backplane module drives the light emitting layer to emit light.

According to an embodiment of the present disclosure, there is provided a display method for use in the display panel described in any of the foregoing embodiments. The display method includes: in a detection phase, the first light emission controller providing a first level to a plurality of pixel rows of the first display region, the second light emission controller providing a second level to a plurality of pixel rows of the second display region row by row at an interval of one clock cycle, the first level turning off the pixel rows, the second level lighting up the pixel rows; and in a display phase, the first light emission controller providing a second level to a plurality of pixel rows of the first display region row by row at an interval of one clock cycle, the second light emission controller providing a second level to a plurality of pixel rows of the second display region row by row at an interval of one clock cycle, two pixel rows that are directly adjacent to each other between the first display region and the second display region receiving the second level at an interval of one clock cycle.

BRIEF DESCRIPTION OF THE DRAWINGS

In order to more clearly illustrate the technical solutions in embodiments of the present disclosure or the prior art, the drawings that need to be used for description of the embodiments or the prior art will be briefly introduced below. Obviously, the drawings in the description below are only some embodiments of the present disclosure. For those of ordinary skill in the art, other drawings may also be obtained based on these drawings without creative work.

DETAILED DESCRIPTION

Figure 1:
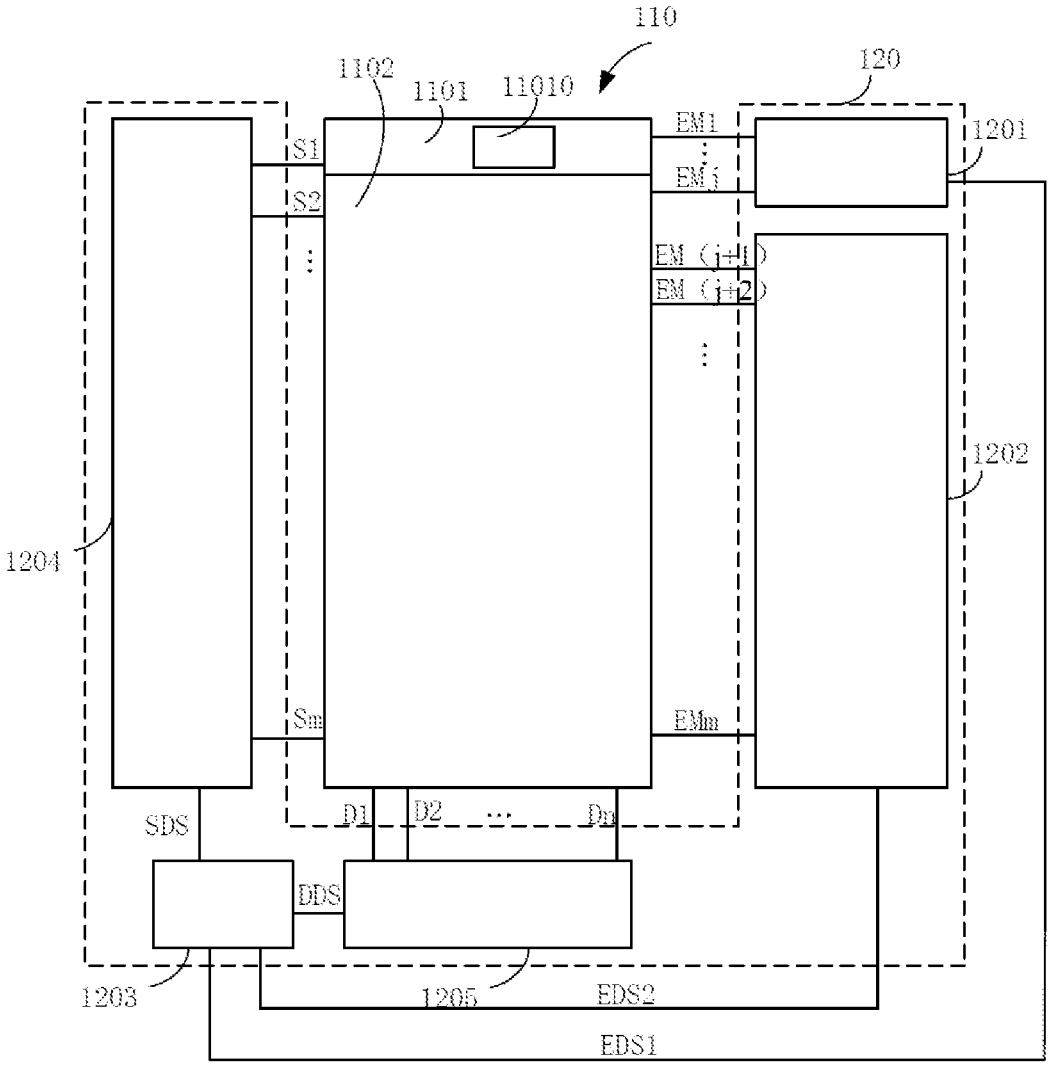
FIG. 1 is a schematic structural view of a display panel according to an embodiment of the present disclosure.

Embodiments of the present disclosure will be described in detail below. Examples of the embodiments are shown in the accompanying drawings, throughout which the same or similar reference numerals denote the same or similar elements or elements with the same or similar functions. The embodiments described below with reference to the accompanying drawings are exemplary, which are only used to explain the present disclosure, and cannot be understood as a limitation to the present disclosure.

In the description of the present disclosure, it should be understood that the terms "first" and "second" are only used for descriptive purposes, and cannot be understood as indicating or implying relative importance or implicitly indicating the number of indicated technical features. Therefore, the features defined with "first" and "second" may explicitly or implicitly include one or more of the features. In the description of the present disclosure, "plurality" means two or more, unless specifically defined otherwise.

The following disclosure provides many embodiments or examples for implementing various structures of the present disclosure. To simplify the present disclosure, components and settings of specific examples are described below. Of course, they are only examples, and are not intended to limit the present disclosure. In addition, the present disclosure may repeat reference numerals and/or reference letters in various examples, and this repetition is for the purpose of simplification and clarity, and does not itself indicate the relationship between the various embodiments and/or settings discussed. Furthermore, the present disclosure provides examples of various specific processes and materials, but those of ordinary skill in the art may be aware of application of other processes and/or use of other materials.

Referring to FIG. 1, a display panel 10 includes a display region 110 and a non-display region 120. The display region 110 includes a first display region 1101 and a second display region 1102. The first display region 1101 includes a transparent sub-display region 11010. The light transmittance of the transparent sub-display region 11010 is higher than the light transmittance of the second display region 1102. The non-display region 120 may be provided with a first light emission controller 1201 and a second light emission controller 1202. The first light emission controller 1201 is configured to provide a light emission control signal to a plurality of pixel rows of the first display region 1101, and the second light emission controller 1202 is configured to provide a light emission control signal to a plurality of pixel rows of the second display region 1102.

Figure 2:
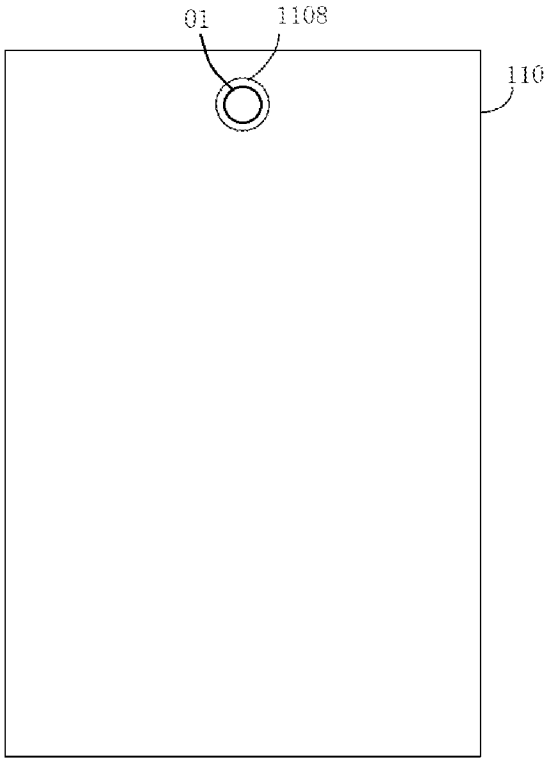
FIG. 2 is a schematic plan view of a display panel according to an embodiment of the present disclosure.
Figure 3:
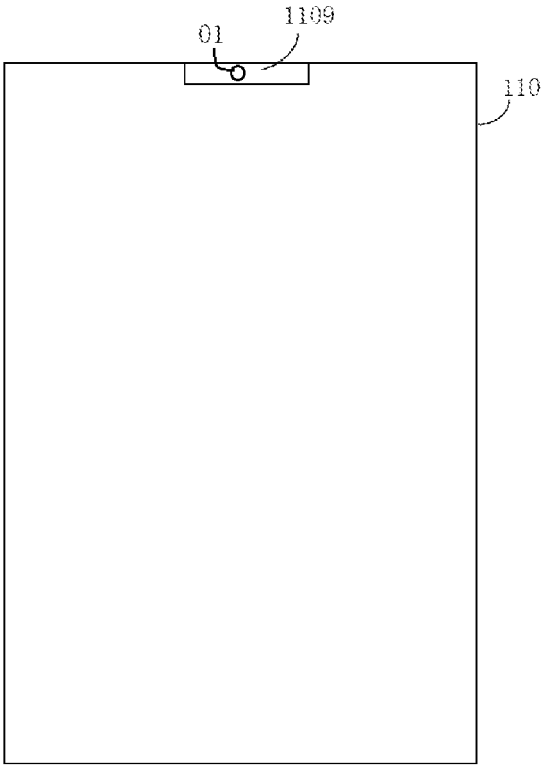
FIG. 3 is a schematic plan view of a display panel according to another embodiment of the present disclosure.

Specifically, referring to FIGS. 2 and 3, in the related art, a photosensitive element 01 such as a front camera, a light sensor, etc. is usually integrated in a perforated region 1108 and a grooved region 1109 of an electronic device such as a smart phone or a tablet computer, etc. In this way, the screen transmittance can be prevented from affecting the operating state of the photosensitive element 01.

In order to achieve a full screen, the photosensitive element 01 may be arranged on the back side (i.e., a side opposite to the light exit side of the display panel 10) of the display panel 10 of an electronic device. However, the display panel 10 has a low light transmittance, and the photosensitive element 01 arranged on the back side of the display panel 10 cannot receive enough light, which causes the photosensitive element 01 to fail to operate normally, for example, less light is acquired by a camera arranged on the back side of the display panel 10, the captured image is poor in quality, etc.

In the display panel 1010 of the embodiment of the present disclosure, the first light emission controller 1201 and the second light emission controller 1202 are used respectively to control the first display region 1101 and the second display region 1102, so that the first display region 1101 and the second display region 1102 emit light according to various light emission control signals. As a result, the interference of light emission of the display panel 10 to the photosensitive element 01 can be reduced. At the same time, a high screen transmittance of the transparent sub-display region 11010 can be maintained and sufficient light input for the photosensitive element can be guaranteed. The photosensitive element 01 arranged on the back side of the display panel 10 can therefore operate precisely as usual.

Further, the transparent sub-display region 11010 may be a region having the same size as the photosensitive element 01 or a size similar to that of the photosensitive element 01. The transparent sub-display region 11010 may also be a region composed of pixel rows to which the photosensitive element 01 corresponds. That is, the transparent sub-display region 11010 may have the same size as the first display region 1101, and may also coincide with the first display region 1101.

Referring again to FIG. 1, in some embodiments, the transparent sub-display region 11010 and the photosensitive element 01 are the same or similar in size. In the detection phase, according to the first level provided by the first light emission controller 1201, the first display region 1101 does not emit light, and the transparent sub-display region 11010 does not emit light, either. According to the second level provided by the second light emission controller 1202, the second display region 1102 emits light. In this way, the largest possible light emitting area can be obtained, and the display effect of the display panel 10 can be optimized.

Figure 4:
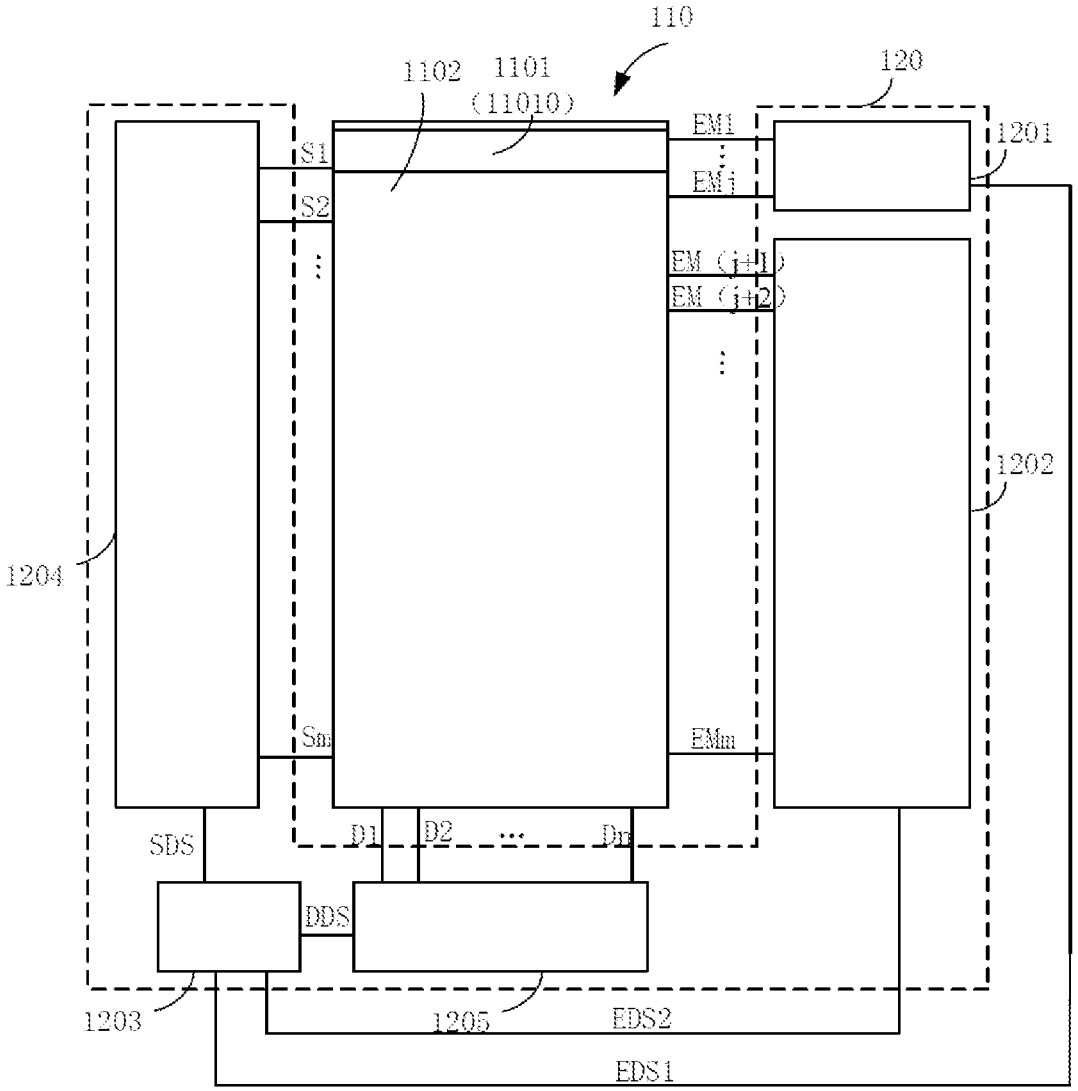
FIG. 4 is a schematic structural view of a display panel according to an embodiment of the present disclosure.

Referring to FIG. 4, in further embodiments, the transparent sub-display region 11010 and the first display region 1101 coincide in shape. In this way, the pixel rows in the first display region 1101 are uniformly manufactured using the same process, which can simplify the manufacturing process and improve the production efficiency.

It can be understood that although the shape of the transparent sub-display region 11010 shown in FIGS. 1 and 4 is a rectangle, in practical applications, the shape of the transparent sub-display region 11010 may also be a circle, a triangle, a polygon, an irregular pattern, etc., which is not specifically limited. Although the first display region 1101 shown in FIG. 1 and FIG. 4 is disposed on the top of the display panel 10, in practical applications, the first display region 1101 may be disposed at any position of the display panel 10, which is not specifically limited.

Figure 9:
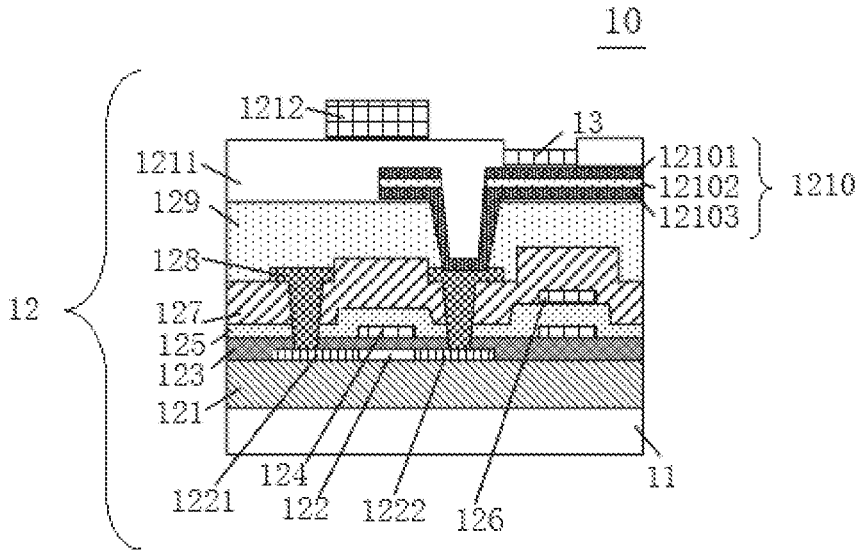
FIG. 9 is a schematic structural view of a display panel according to an embodiment of the present disclosure.
Figure 10:
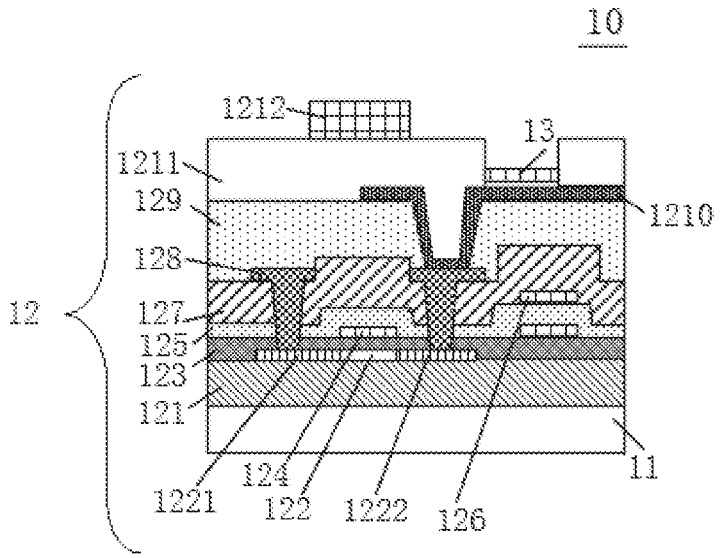
FIG. 10 is a schematic structural view of a display panel according to an embodiment of the present disclosure.

In addition, a pixel anode 1210 of the transparent sub-display region 11010 (as shown in FIGS. 9 and 10) may be made of a transparent material. The transparent material may be a material with a transparency greater than or equal to 90%, such as indium tin oxide, indium zinc oxide, silver-doped indium tin oxide, or silver-doped indium zinc oxide, etc., which is not specifically limited. In this way, the light transmittance of the anode 1210 of the transparent sub-display region 11010 can be increased, which thus increases the light transmittance of the first display region 1101.

Those skilled in the art can understand that the pixel anode 1210, the light emitting layer 13, and the pixel cathode (not shown) may constitute a light emitting element. To simplify the description, the pixel cathode is not drawn in the drawings.

In some embodiments, the display panel 10 includes a timing controller 1203, and the timing controller 1203 is configured to provide a light emission driving signal to the first light emission controller 1201 and the second light emission controller 1202.

Specifically, the timing controller 1203 is connected to the first light emission controller 1201 via a first light emission driving signal line EDS1, and the timing controller 1203 is connected to the second light emission controller 1202 via a second light emission driving signal line EDS2. The first light emission controller 1201 and the second light emission controller 1202 are connected to the pixel rows via light emission control signal lines. The first light emission controller 1201 controls light emission control signal lines EM1-EMj, and the second light emission controller 1202 controls light emission control signal lines EM(j+1)–EMm, where in is the total number of pixel rows of the display panel 10. The specific value of in may be determined according to the actual size of the display panel 10, which is not specifically limited.

Figure 5:
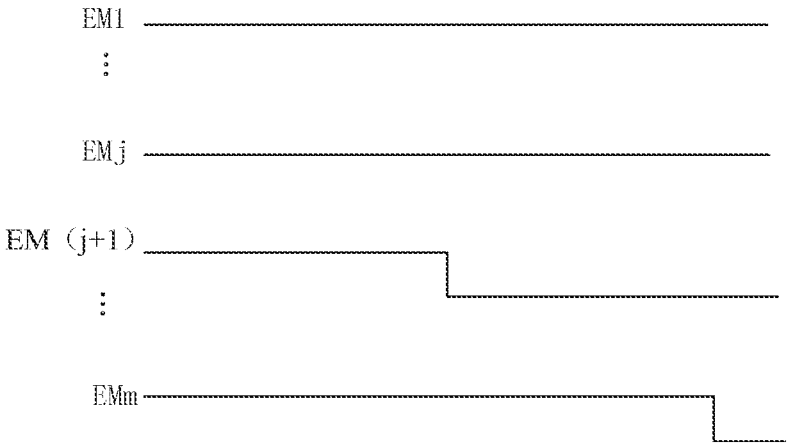
FIG. 5 is a circuit timing diagram according to an embodiment of the present disclosure.

Referring to FIG. 5, in some embodiments, the transparent sub-display region 11010 and the first display region 1101 coincide in shape. In the detection phase, according to the first level provided by the first light emission controller 1201, the first display region 1101 does not emit light. According to the second level provided by the second light emission controller 1202, the second display region 1102 emits light. The first level may be a high level, and the second level may be a low level. In the pixel rows controlled by the second light emission controller 1202, except for the pixel row to which EM(j+1) corresponds, the second level of each pixel row is delayed by one clock cycle from the second level of the previous pixel row.

Figure 6:
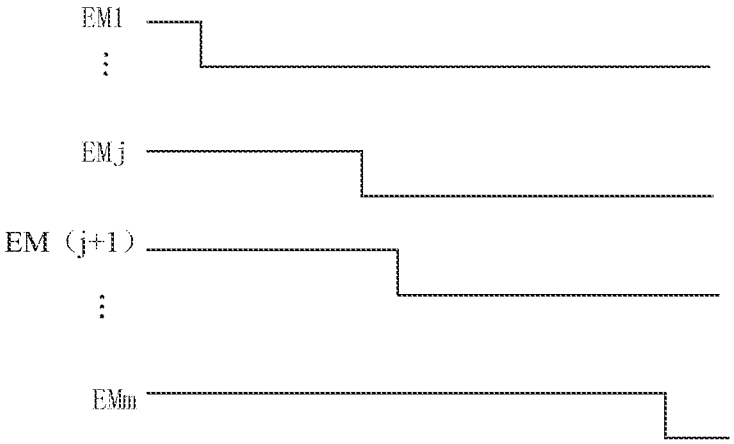
FIG. 6 is a circuit timing diagram according to an embodiment of the present disclosure.

Referring to FIG. 6, in the display phase, the first light emission controller 1201 and the second light emission controller 1202 successively delay providing the second level by one clock cycle row by row, wherein the second level may be a low level. That is, the second level provided by the first light emission controller 1201 and the second light emission controller 1202 is in a continuous state, and the second level of EM(j+1) is delayed by one clock cycle from the second level of EMj.

As a result, it is possible to make the first display region 1101 not emit light in the detection phase and emit light according to the light emission control signal in the display phase, thereby reducing the interference of the light emission of the display panel 10 to the photosensitive element 01. At the same time, since the pixel anode 1210 of the transparent sub-display region 11010 is made of a transparent material, the screen transmittance of the transparent sub-display region 11010 is high, and the photosensitive element 01 arranged on the back side of the display panel 10 can therefore operate precisely as usual.

In some embodiments, the display panel 10 includes a gate driver 1204. The gate driver 1204 is configured to provide a gate driving signal to the pixel row of the display region 110, and the timing controller 1203 is configured to provide a scan driving signal to the gate driver 1204.

Specifically, the gate driver 1204 is connected to the timing controller 1203 via a gate driving signal line SDS, and connected to the pixel row via a gate control signal line. The gate control signal lines S1-Sj are connected to the pixel rows of the first display region 1101, the gate control signal lines S(j+1)–Sm are connected to the pixel rows of the second display region 1102, where in is the total number of pixel rows of the display panel 10. The specific value of in may be determined according to the actual size of the display panel 10, which is not specifically limited. The gate driver 1204 performs progressive scanning under the control of the scan driving signal.

It can be understood that, since the display region 110 includes the first display region 1101 and the second display region 1102, a first gate driver and a second gate driver may also be provided accordingly.

In some embodiments, a gate driver 1204 is provided. The gate driver 1204 provides gate driving signals to the first display region 1101 and the second display region 1102 simultaneously, and realizes progressive scanning of the display region 110 according to the scan driving signals.

In further embodiments, a first gate driver and a second gate driver are provided. The first gate driver provides a gate driving signal to the first display region 1101, and the second gate driver provides a gate driving signal to the second display region 1102. In this way, separate control of the gate driving signals of the first display region 1101 and the second display region 1102 is realized, which facilitates the upgrade and maintenance of the first display region 1101 and the second display region 1102, respectively.

In some embodiments, the display panel 10 includes a data driver 1205. The data driver 1205 is configured to provide data signals to the pixel columns of the display region 110, and the timing controller 1203 is configured to provide a data driving signal to the data driver 1205.

Specifically, the data driver 1205 is connected to the timing controller 1203 via a data driving signal line DDS, and connected to the pixel columns via the data control signal lines D1-Dn, where n is the total number of pixel columns of the display panel 10. The specific value of n may be determined according to the actual size of the display panel 10, which is not specifically limited.

Figure 7:
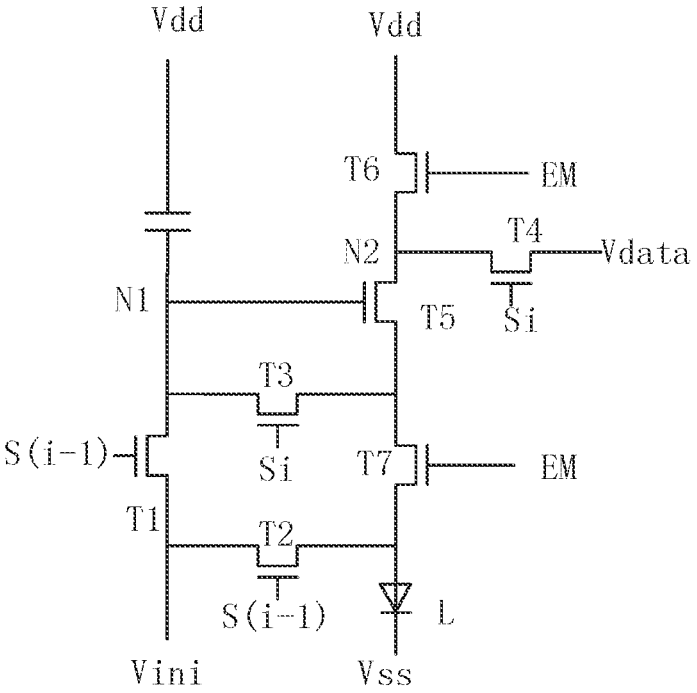
FIG. 7 is a circuit principle diagram of a pixel driving circuit according to an embodiment of the present disclosure.
Figure 8:
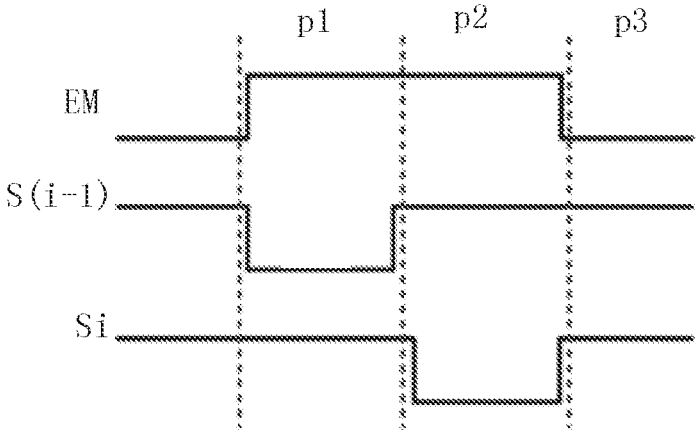
FIG. 8 is a circuit timing diagram according to an embodiment of the present disclosure.

Referring to FIGS. 7 and 8, in the first phase p1, the light emission control signal line EM outputs the first level, the gate control signal line S(i−1) outputs the second level, and the gate control signal line Si outputs the first level. At that time, a first transistor T1 and a second transistor T2 are turned on. The first transistor T1 is turned on so that an initialization voltage Vini is transmitted to a first node N1, and a storage capacitor C is charged and discharged. The second transistor T2 is turned on so that the initialization voltage Vini is transmitted to the anode of a light emitting element L, and the light emitting element L is discharged.

It is to be noted that, in the case where the displayed gray level is low and the capacitance of the light emitting element L is insufficiently discharged, the light emitting element L is brighter, which easily affects the yield of the low gray scale pixel Gamma correction and the display contrast. In addition, the second transistor T2 may further involve a leakage phenomenon. Therefore, in order to ensure that the capacitance of the light-emitting element L is sufficiently discharged, the initialization voltage Vini is usually low.

In the second phase p2, the light emission control signal line EM outputs the first level, the gate control signal line S(i−1) outputs the first level, and the gate control signal line Si outputs the second level. At that time, a third transistor T3 and a fourth transistor T4 are turned on. The fourth transistor T4 is turned on so that a data signal Vdata is transmitted to a second node N2. The third transistor T3 is turned on so that a fifth transistor T5 is turned on. Since the voltage difference between the gate and the source of the fifth transistor is Vgs=Vini−Vdata, and Vgs<Vth, where Vth is a threshold voltage of the fifth transistor, the storage capacitor C starts to be charged, and the potential of the first node N1 rises. When the potential of the first node N1 is Vdata+Vth, the charging of the fifth transistor T5 ends.

In the third phase p3, the light emission control signal line EM outputs the second level, the gate control signal line S(i−1) outputs the first level, and the gate control signal line Si outputs the first level. At that time, a sixth transistor T6 and a seventh transistor T7 are turned on. A light emitting signal Vdd is transmitted to the anode of the light emitting element L, and the light emitting element L emits light.

It can be understood that when the pixel circuit shown in FIG. 8 is a P-type thin film transistor circuit, the first level may be a high level, and the second level may be a low level. When the pixel circuit shown in FIG. 8 is an N-type thin film transistor circuit, the first level may be a low level, and the second level may be a high level.

It can be seen from the above that when the display panel 10 is in operation, in the first phase p1, the gate driver 1204 controls the pixel row Si to initialize according to the scan driving signal. In the second phase p2, the data driver 1205 controls the pixel columns D1-Dn of the pixel row Si to write the data signal Vdata according to the scan driving signal and the data driving signal. In the third phase p3, according to the light emission control signal, the first light emission controller 1201 or the second light emission controller 1202 controls the pixels in the display panel 10 to emit light according to the written data.

As a result, the display panel 10 realizes progressive scanning according to the gate driving signal, and controls the pixels to emit light according to the data signal and the light emission control signal.

In some embodiments, the pixel anode 1210 of the transparent sub-display region 11010 is a pixel anode of a multilayer structure.

Specifically, referring to FIG. 9, in some embodiments, the pixel anode 1210 of the transparent sub-display region 11010 has a multilayer structure, including a top layer 12101, an intermediate layer 12102 and a bottom layer 12103. Taking an organic light emitting diode (OLED) as an example, the top layer 12101, the intermediate layer 12102 and the bottom layer 12103 of the OLED may be made of a transparent material such as indium tin oxide, indium zinc oxide, silver-doped indium tin oxide or silver-doped indium zinc oxide.

In some embodiments, the pixel anode 1210 of the transparent sub-display region 11010 is a pixel anode of a monolayer structure.

Referring to FIG. 10, in further embodiments, the pixel anode 1210 of the transparent sub-display region 11010 has a monolayer structure, and the anode of the transparent sub-display region 11010 may be made of a transparent material such as indium tin oxide, indium zinc oxide, silver-doped indium tin oxide or silver-doped indium zinc oxide. In this way, the light transmittance of the anode 1210 of the transparent sub-display region 11010 can be increased, which thus increases the light transmittance of the first display region 1101.

In addition, in the display region 110, the pixel anode outside the transparent sub-display region 11010 may also employ a monolayer structure, which is made of a transparent material such as indium tin oxide, indium zinc oxide, silver-doped indium tin oxide, or silver-doped indium zinc oxide. In this way, the light transmittance of the anode of the display region 110 can be increased.

In some embodiments, the display panel 10 includes a base substrate 11, a backplane module 12 and a light emitting layer 13 stacked in sequence, and the light emitting layer 13 is electrically connected to the pixel anode 1210. The first light emission controller 1201 and the second light emission controller 1202 are configured to provide a light emission driving signal to the backplane module 12, so that the backplane module 12 drives the light emitting layer 13 to emit light.

Specifically, referring to FIG. 10 again, the display panel 10 includes a base substrate 11, a backplane module 12, and a light emitting layer 13 stacked in sequence. The backplane module 12 includes a buffer layer 121, an active layer 122, a first gate insulating layer 123, a first gate layer 1241, a second gate insulating layer 125, a second gate layer 126, an interlayer dielectric layer 127, a source/drain electrode layer 128, a planarization layer 129, an anode 1210, a pixel defining layer 1211, and a support layer 1212 stacked in sequence.

The base substrate 11 may be made of a silicate-type non-metallic material or a flexible material, etc., for example, the flexible material may be polyimide, thermoplastic polyester, and the like, which is not specifically limited. The buffer layer 121 may be made of a film layer such as silicon nitride or silicon oxide, which can play the role of planarization and blocking the diffusion of impurity components on the base substrate 11. The active layer 122 may be a-silicon, low-temperature polysilicon, an oxide semiconductor, etc., and a channel of a thin film transistor is formed in the active layer 122, such as P-channel, N-channel, and the like. A source region 1221 and a drain region 1222 of the thin film transistor may be formed in the active layer 122. The first gate insulating layer 123 and the second gate insulating layer 125 may be made of a film layer such as silicon nitride or silicon oxide, wherein the second gate insulating layer 125 is a dielectric layer of the storage capacitor. The first gate layer 124 and the second gate layer 126 may be made of a metal such as molybdenum. The first gate layer 124 is the gate of the thin film transistor and also serves as a first electrode of the storage capacitor. The second gate layer 126 serves as a second electrode of the storage capacitor. The orthographic projection of the first electrode on the base substrate 11 and that of the second electrode on the base substrate 11 at least partially overlap, so that a storage capacitor can be formed. The source/drain electrode layer 128 may be made of a metal such as titanium and aluminum, and the source/drain electrode layer 128 is connected to the source region 1221 and the drain region 1222 of the thin film transistor through via holes. The interlayer dielectric layer 127 and the planarization layer 129 play the role of planarization and passivation, which can protect the thin film transistor. The interlayer dielectric layer 127 may be made of a film layer such as silicon nitride or silicon oxide, and the planarization layer 129 may be made of an organic material such as polyimide. The pixel defining layer 1211 can define the light emitting region, for example, defining the size of the light exit area, etc. The pixel defining layer 1211 and the support layer 1212 may be made of an organic material such as polyimide. The anode 1210 is connected to the source/drain electrode layer 128 of the thin film transistor through a via hole formed in the planarization layer 129. The light emitting layer 13 emits light according to the light emission driving signal provided by the backplane module 12.

As a result, a pixel driving circuit of the display panel is formed by the multilayer structures in cooperation with each other, and the light emitting effect of the display panel 10 is realized.

Figure 11:
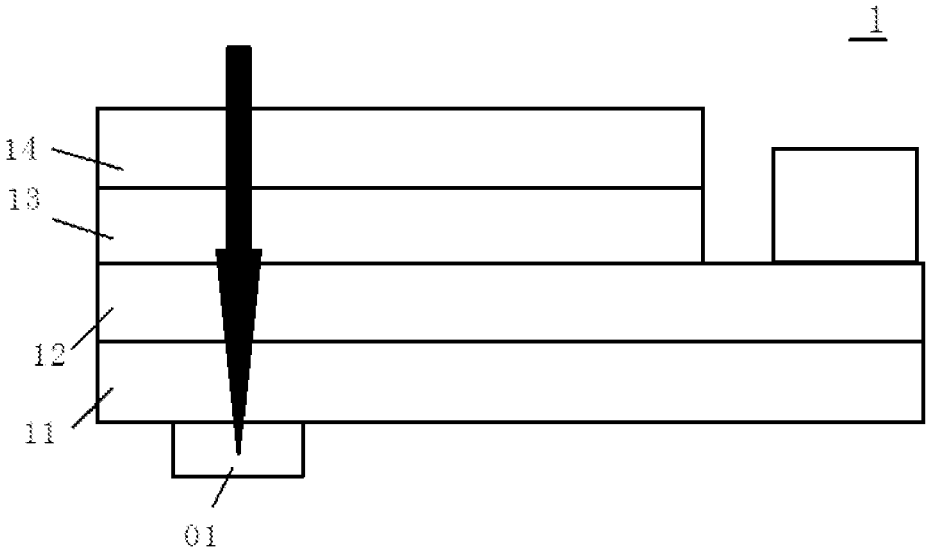
FIG. 11 is a schematic structural view of a display device according to an embodiment of the present disclosure.

Referring to FIG. 11, in some embodiments, a display device 1 includes an optical module 14, and the optical module 14 includes at least one of a polarizer, an optical glue and a cover glass.

Specifically, the polarizer can be used to reduce the glare phenomenon of the display device 1 and improve the display effect of the display device 1. The optical glue can be used for components in the display device 1, making the display device 1 more compact and robust. The cover glass can be used to protect internal components of the display device 1 from being influenced by corrosion of external dust, water, gas and other impurities.

In addition, in a flexible display device, a thin film encapsulation may also be used instead of the cover glass. The thin film encapsulation has water and oxygen insulation properties.

Referring to FIG. 11 again, a display device 1 according to an embodiment of the present disclosure includes the display panel 10 described in any of the foregoing embodiments and a photosensitive element 01. The photosensitive element 01 is disposed on the back side of the display panel 10 corresponding to the transparent sub-display region 11010, so as to receive light (denoted by the arrow in FIG. 11) passing through the transparent sub-display region 11010.

In some embodiments, the photosensitive element 01 includes at least one of a photographing camera, an infrared camera, an infrared rangefinder, and an optical fingerprint sensor.

Referring to FIG. 11, the photosensitive element 01 is disposed on the back side of the display panel 10, so it can receive light passing through the optical module 14 and the base substrate 11. In embodiments of the present disclosure, the photosensitive element 01 performs one or more optical detections such as photographing, distance measurement, fingerprint recognition, etc. in the detection phase.

Specifically, the display device 1 may be a mobile phone, a tablet computer, a teller machine, a smart wearable device, a smart home appliance, a game console, a head-mounted display device, and the like, which is not specifically limited. It can be understood that the display device 1 may also be any other device with a display function. The photosensitive element 01 includes at least one of a photographing camera, an infrared camera, an infrared rangefinder, and an optical fingerprint sensor.

In the display device 1 according to the embodiment of the present disclosure, the first light emission controller 1201 and the second light emission controller 1202 are used respectively to control the first display region 1101 and the second display region 1102, so that the first display region 1101 and the second display region 1102 emit light according to various light emission control signals, which can reduce the interference of the light emission of the display panel 10 to the photosensitive element 01. At the same time, the pixel anode 1210 of the transparent sub-display region 11010 is made of a transparent material, which can maintain a high screen transmittance of the transparent sub-display region 11010 and guarantee sufficient light input for the photosensitive element.

Figure 12:
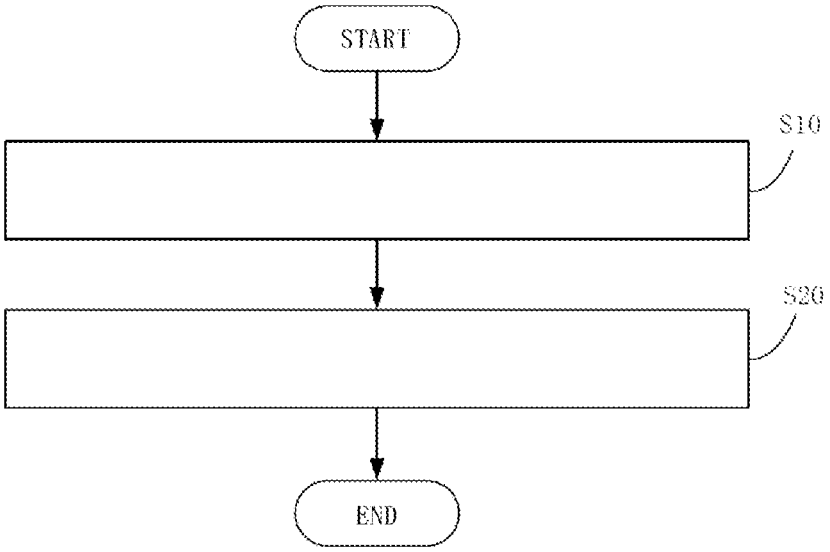
FIG. 12 is a flow chart of a display method according to an embodiment of the present disclosure.

Referring to FIG. 12, a display method according to an embodiment of the present disclosure is for use in the display panel 10 described in any of the foregoing embodiments. The display method includes the following steps.

S10: in the detection phase, the first light emission controller 1201 providing a first level to a plurality of pixel rows of the first display region, and the second light emission controller providing a second level to a plurality of pixel rows of the second display region row by row at an interval of one clock cycle; the first level turning off the pixel rows, and the second level lighting up the pixel rows.

S20: in the display phase, controlling the first light emission controller 1201 to provide a second level to a plurality of pixel rows of the first display region row by row at an interval of one clock cycle, and the second light emission controller to provide a second level to a plurality of pixel rows of the second display region row by row at an interval of one clock cycle; two pixel rows directly adjacent to each other between the first display region and the second display region receiving the second level at an interval of one clock cycle.

Specifically, specific example of the display method according to the embodiment of the present disclosure has been included in the above-described embodiments of the display panel 10, and will not be repeated here. In the context of the present disclosure, "turning off the pixel rows" means making the pixel rows not emit light, and "lighting up the pixel rows" means making the pixel rows emit light.

In the display method according to the embodiment of the present disclosure, the first level is provided to the first light emission controller 1201 and the second level is provided to the second light emission controller 1202 in the detection phase, and the second level is provided to the first light emission controller 1201 and the second light emission controller 1202 in the display phase, thus the display panel can be controlled to realize display modes in various phases. In cooperation with the display panel 10 according to the embodiment of the present disclosure, this enables the first display region 1101 and the second display region 1102 to emit light according to various light emission control signals, which can reduce the interference of the light emission of the display panel 10 to the photosensitive element 01 and maintain a high screen transmittance of the transparent sub-display region 11010.

In the context of the present disclosure, components such as the first light emission controller, the second light emission controller, the timing controller, the gate driver, the data driver, etc. can be implemented by a suitable circuit or a combination of a single-chip microcomputer and a suitable circuit. Those skilled in the art can understand that the present disclosure is not intended to improve the hardware structure of the controller/driver described above. Therefore, the controller/driver in the related art can also be used to realize the corresponding operations.

In the description of this specification, the descriptions with reference to the terms "one embodiment", "some embodiments", "exemplary embodiments", "examples", "specific examples" or "some examples", etc. mean that specific features, structures, materials or characteristics described in conjunction with the embodiments or examples are included in at least one embodiment or example of the present disclosure. In this specification, the schematic representations of the above-mentioned terms do not necessarily refer to the same embodiment or example. Moreover, the described specific features, structures, materials or characteristics may be combined in an appropriate manner in any one or more embodiments or examples.

It is to be noted that relational terms such as first and second are solely used herein to distinguish one entity or operation from another without necessarily requiring or implying any actual such relationship or order between these entities or operations. Moreover, the terms "comprise", "include" or any other variation thereof are intended to encompass non-exclusive inclusion such that a process, method, article or device that includes a series of elements includes not only those elements but also other elements not explicitly listed, or also includes elements inherent to such a process, method, article or device. Without further limitation, elements defined by the phrase "comprising one . . . " do not preclude the presence of additional identical elements in a process, method, article, or device that includes said elements. The orientations or positional relationships indicated by the terms such as "upper" and "lower" are based on orientations or positional relationships shown in the drawings, which are only for facilitating description of the present disclosure and simplifying description, rather than indicating or implying that the indicated apparatus or element must have a specific orientation, or must be constructed and operated in a particular orientation, thus they cannot be construed as limitations to the present disclosure. Unless expressly specified and defined otherwise, the terms "installation", "connected" and "connection" should be understood broadly, for example, they can be fixed connection, detachable connection or integral connection; they can be mechanical connection or electrical connection; and they can be direct connection or indirect connection via an intermediate medium or communication between two elements. Those ordinarily skilled in the art may understand the specific meanings of the above terms in the present disclosure based on specific situations.

In the specification of the present disclosure, numerous specific details are set forth. It is to be understood, however, that the embodiments of the present disclosure may be practiced without these specific details. In some examples, well-known methods, structures, and techniques have not been shown in detail in order not to obscure the understanding of this specification. Similarly, it should be understood that in order to simplify the disclosure and assist in the understanding of one or more of the respective disclosed aspects, in the above description of exemplary embodiments of the present disclosure, various features of the present disclosure are sometimes grouped together into a single embodiment, graph or description thereof. However, the method of the present disclosure should not be interpreted as reflecting the intention that the claimed disclosure requires more features than those expressly recited in each claim. Rather, as reflected by the claims, the disclosed aspects lie in less than all the features of the previously disclosed single embodiment. Accordingly, the claims following the detailed description are hereby expressly incorporated into the detailed description, with each claim acting as a separate embodiment of the present disclosure.

Although the embodiments of the present disclosure have been illustrated and described, those of ordinary skill in the art can understand that various changes, modifications, substitutions and variations can be made to these embodiments without departing from the principle and purpose of the present disclosure. The scope of the present disclosure is defined by the claims and their equivalents.

REFERENCE SIGNS display device 1, photosensitive element 01, display panel 10, display region 110, first display region 1101, transparent sub-display region 11010, second display region 1102, perforated region 1108, grooved region 1109, base substrate 11, backplane module 12, buffer layer 121, active layer 122, source region 1221, drain region 1222, first gate insulating layer 123, first gate layer 124, second gate insulating layer 125, second gate layer 126, interlayer dielectric layer 127, source/drain electrode layer 128, planarization layer 129, anode 1210, top layer 12101, intermediate layer 12102, bottom layer 12103, pixel defining layer 1211, support layer 1212, light emitting layer 13, optical module 14, non-display region 120, first light emission controller 1201, second light emission controller 1202, first light emission driving signal line EDS1, second light emission driving signal line EDS2, light emission control signal line EM, gate driving signal line SDS, gate control signal line S, data driving signal line DDS, data control signal line D, drain voltage Vdd, source voltage Vss, initialization voltage Vini, data signal Vdata, first node N1, second node N2, storage capacitor C, light emitting element L, first transistor T1, second transistor T2, third transistor T3, fourth transistor T4, fifth transistor T5, sixth transistor T6, seventh transistor T7, timing controller 1203, gate driver 1204, data driver 1205.

What is claimed is:

1. A display panel comprising:

a display region, the display region comprising a first display region and a second display region, the first display region comprising a transparent sub-display region, the transparent sub-display region having a light transmittance higher than a light transmittance of the second display region;

a first light emission controller and a second light emission controller, the first light emission controller being configured to provide a light emission control signal to a plurality of pixel rows of the first display region, the second light emission controller being configured to provide a light emission control signal to a plurality of pixel rows of the second display region; and a base substrate, a backplane module, and a light emitting layer that are stacked in sequence;

wherein the light emitting layer comprises a pixel anode, and the first light emission controller and the second light emission controller are configured to provide a light emission driving signal to the backplane module so that the backplane module drives the light emitting layer to emit light, wherein the backplane module comprises a buffer layer, an active layer, a first gate insulating layer, a first gate layer, a second gate insulating layer, a second gate layer, an interlayer dielectric layer, a source/drain electrode layer, a planarization layer, an anode, a pixel defining layer and a support layer that are stacked in sequence.

2. The display panel according to claim 1, further comprising: a timing controller;

wherein the timing controller is configured to provide a light emission driving signal to the first light emission controller and the second light emission controller.

3. The display panel according to claim 2, further comprising: a gate driver;

wherein the gate driver is configured to provide a gate driving signal to a pixel row of the display region, and the timing controller is configured to provide a scan driving signal to the gate driver.

4. The display panel according to claim 2, further comprising: a data driver;

wherein the data driver is configured to provide a data signal to a pixel column of the display region, and the timing controller is configured to provide a data driving signal to the data driver.

5. The display panel according to claim 1, wherein a pixel anode of the transparent sub-display region is made of a transparent material; the transparent material comprises at least one of indium tin oxide, indium zinc oxide, silver-doped indium tin oxide, and silver-doped indium zinc oxide.

6. The display panel according to claim 5, wherein the pixel anode of the transparent sub-display region is a pixel anode of a monolayer structure.

7. The display panel according to claim 5, wherein the pixel anode of the transparent sub-display region is a pixel anode of a multilayer structure.

8. The display panel according to claim 1, further comprising: an optical module;

wherein the optical module comprises at least one of a polarizer, an optical glue and a cover glass.

9. The display panel according to claim 1, wherein the transparent sub-display region coincides with the first display region.

10. The display panel according to claim 1, further comprising: a non-display region adjacent to the display region;

wherein the first light emission controller and the second light emission controller are located within the non-display region.

11. A display method for use in the display panel according to claim 1; the display method comprising:

in a detection phase, the first light emission controller providing a first level to a plurality of pixel rows of the first display region, the second light emission controller providing a second level to a plurality of pixel rows of the second display region row by row at an interval of one clock cycle; the first level turning off the pixel rows, the second level lighting up the pixel rows; and in a display phase, the first light emission controller providing a second level to a plurality of pixel rows of the first display region row by row at an interval of one clock cycle, the second light emission controller providing a second level to a plurality of pixel rows of the second display region row by row at an interval of one clock cycle, two pixel rows that are directly adjacent to each other between the first display region and the second display region receiving the second level at an interval of one clock cycle.

12. A display device comprising a display panel and a photosensitive element, the photosensitive element being arranged on a back side of the display panel, wherein the display panel comprises:

a display region, the display region comprising a first display region and a second display region, the first display region comprising a transparent sub-display region, the transparent sub-display region having a light transmittance higher than a light transmittance of the second display region;

a first light emission controller and a second light emission controller, the first light emission controller being configured to provide a light emission control signal to a plurality of pixel rows of the first display region, the second light emission controller being configured to provide a light emission control signal to a plurality of pixel rows of the second display region, wherein the transparent sub-display region corresponds to a region where the photosensitive element is located and is smaller than the first display region, and the photosensitive element is configured to receive light passing through the transparent sub-display region, wherein the display panel comprises a base substrate, a backplane module, and a light emitting layer that are stacked in sequence;

wherein the light emitting layer comprises a pixel anode, and the first light emission controller and the second light emission controller are configured to provide a light emission driving signal to the backplane module so that the backplane module drives the light emitting layer to emit light, wherein the backplane module comprises a buffer layer, an active layer, a first gate insulating layer, a first gate layer, a second gate insulating layer, a second gate layer, an interlayer dielectric layer, a source/drain electrode layer, a planarization layer, an anode, a pixel defining layer and a support layer that are stacked in sequence.

13. The display device according to claim 12, wherein the photosensitive element comprises at least one of a photographing camera, an infrared camera, an infrared rangefinder, and an optical fingerprint sensor.

14. The display device according to claim 12, further comprising: a timing controller;

wherein the timing controller is configured to provide a light emission driving signal to the first light emission controller and the second light emission controller.

15. The display device according to claim 14, further comprising: a gate driver;

wherein the gate driver is configured to provide a gate driving signal to a pixel row of the display region, and the timing controller is configured to provide a scan driving signal to the gate driver.

16. The display device according to claim 14, further comprising: a data driver;

wherein the data driver is configured to provide a data signal to a pixel column of the display region, and the timing controller is configured to provide a data driving signal to the data driver.

17. The display device according to claim 12, wherein a pixel anode of the transparent sub-display region is made of a transparent material; the transparent material comprises at least one of indium tin oxide, indium zinc oxide, silver-doped indium tin oxide, and silver-doped indium zinc oxide.

* * * * *